US012303088B2

(12) United States Patent
Metzel

(10) Patent No.: US 12,303,088 B2
(45) Date of Patent: May 20, 2025

(54) RELEASE LEVER FOR CLEANING DEVICE

(71) Applicant: CARL FREUDENBERG KG, Weinheim (DE)

(72) Inventor: Doug Metzel, Lombard, IL (US)

(73) Assignee: CARL FREUDENBERG KG, Weinheim (DE)

( * ) Notice: Subject to any disclaimer, the term of this patent is extended or adjusted under 35 U.S.C. 154(b) by 312 days.

(21) Appl. No.: 18/168,589

(22) Filed: Feb. 14, 2023

(65) Prior Publication Data

US 2024/0268623 A1 Aug. 15, 2024

(51) Int. Cl.
*A47L 13/42* (2006.01)
*A47L 13/254* (2006.01)

(52) U.S. Cl.
CPC ..... *A47L 13/42* (2013.01); *A47L 13/254* (2013.01)

(58) Field of Classification Search
CPC ..... A47L 13/24; A47L 13/42–48; A47L 13/254–258; A47L 2201/00; A47L 9/0494; A47L 9/0411; A47L 11/4036; B25G 3/04
USPC ..... 15/104.001, 244.1, 148
See application file for complete search history.

(56) References Cited

U.S. PATENT DOCUMENTS

| | | | | |
|---|---|---|---|---|
| 3,157,901 | A | 11/1964 | Murphy | |
| 5,625,918 | A | 5/1997 | Kieson et al. | |
| 9,179,815 | B2 * | 11/2015 | Davidshofer | A47L 13/254 |
| 2006/0260084 | A1 * | 11/2006 | Guizzi | A47L 1/06 15/245 |
| 2015/0089757 | A1 | 4/2015 | Davidshofer et al. | |

FOREIGN PATENT DOCUMENTS

| | | | |
|---|---|---|---|
| EP | 2945521 | B1 | 10/2018 |
| WO | WO 2022/022945 | A1 | 2/2022 |

* cited by examiner

*Primary Examiner* — Robert F Neibaur
(74) *Attorney, Agent, or Firm* — LEYDIG, VOIT & MAYER, LTD.

(57) ABSTRACT

A cleaning device, including a cleaning head receiver, a cleaning head frame, a cleaning material attached to the cleaning head frame, and a release lever having a handle at a first end and an ejecting surface at a second end. The release lever is arranged within the cleaning head receiver. The release lever is configured to rotate and thereby apply an ejecting force against the cleaning head frame via the ejecting surface.

13 Claims, 6 Drawing Sheets

RELEASE LEVER FOR CLEANING DEVICE

FIELD

The present invention relates to a release lever for releasing a cleaning element from a fixed position in a cleaning device.

BACKGROUND

Conventional cleaning devices include a cleaning element attached to a rod. The rod allows versatile control of the cleaning element to a user, as well as enabling a user to apply force to a cleaning surface with the cleaning element. A handle is typically included at or near an end of the rod opposing the cleaning element so that a user may more comfortably grip and manipulate the cleaning device. The cleaning element may be made of a variety of materials, but typically includes a textile with or without fringes, the textile being used to scrub and absorb dirt, dust, or other forms of debris on a cleaning surface. In some conventional cleaning devices, the cleaning element is permanently fixed to the rod. While such cleaning devices may be cheaper to manufacture, they are not suitable for versatile cleaning tasks, as only one type of cleaning element for a limited range of cleaning tasks may be attached to the rod throughout the life of the cleaning device. Such cleaning devices also require a particular procedure for cleaning the cleaning element when it becomes soiled, such as wringing the cleaning element in a wringing device of a mop bucket. Because the cleaning element cannot be separated from the cleaning device, the cleaning element and the remaining components of the cleaning device cannot be cleaned separately. Such cleaning devices are also inefficient in terms of sustainability, as it is typically easier to replace the cleaning device entirely than to replace a broken, defective, or irreversibly soiled cleaning element.

Some cleaning devices exist which include replaceable and/or interchangeable cleaning elements. However, the means for securing the cleaning element to a rod in such devices are limited in terms of rigidity, ease of use, the time required to switch out cleaning elements, and/or durability. Furthermore, the experience of replacing or changing cleaning elements is unpleasant because a user is required to touch a cleaning element to remove it from the rod. Therefore, what is needed is a cleaning device with a release mechanism facilitating quick attachment and detachment of a cleaning element from a cleaning device and addresses the foregoing deficiencies.

SUMMARY

A cleaning device, comprising a cleaning head receiver, a cleaning head frame, a cleaning material attached to the cleaning head frame, and a release lever having a handle at a first end and an ejecting surface at a second end. The release lever is arranged within the cleaning head receiver. The release lever is configured to rotate and thereby apply an ejecting force against the cleaning head frame via the ejecting surface.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Embodiments of the present disclosure relate to a cleaning device that includes an interchangeable cleaning head. The cleaning head may include a cleaning element that is attached to a cleaning element frame. The cleaning element can include cloth, fibers, or other materials used to absorb liquid, scrub a surface, and/or wipe and collect debris from a dirty or soiled surface. The cleaning element frame can include a solid structure onto which or through which parts of the cleaning element are attached, thereby forming a cartridge-like cleaning head that is interchangeable with other cleaning heads. A single cleaning device may thus include a cleaning element receiver configured to receive and secure a cleaning element frame while a cleaning operation is performed or while the cleaning device is stored. A single device may be used with several interchangeable cleaning heads of the same type or of varying types. Some particular features of the cleaning element itself are described in International Application Publication No. WO 2022/022945 A1, which is hereby incorporated by reference.

Embodiments of the present disclosure provide a release mechanism for releasing a cleaning element from a cleaning element receiver of a cleaning device. The release mechanism. The release mechanism includes a lever configured to pivot within the cleaning element receiver, thereby applying a force against a cleaning element's frame within the cleaning element receiver. The lever enables a user of the cleaning device to easily apply a force to the lever sufficient for freeing a cleaning element frame from within the cleaning element receiver. Because the lever allows for quick application of a force that is directed at a portion of the cleaning element, the lever forces the cleaning element frame, and thus an associated cleaning element, out from within the cleaning element receiver in a manner that reduces deformation or wear that would occur as a result of inefficiently applied forces against the cleaning element and/or the cleaning element receiver. By making release of a cleaning element from a cleaning device simpler and easier, embodiments of the present disclosure enable cleaning devices to include a more versatile range of cleaning elements with varying functions and/or qualities. Furthermore, disclosed embodiments of the release mechanism enable a user to replace a cleaning element within a cleaning device without having to touch a cleaning element that has been soiled after a cleaning operation. Disclosed embodiments of the release mechanism can also be manufactured at low cost due to a minimal number of parts and simple integration within a cleaning element receiver. Disclosed embodiments also improve cleaning device operability due to a simple release mechanism design that is intuitive to understand and operate.

Figure 1:
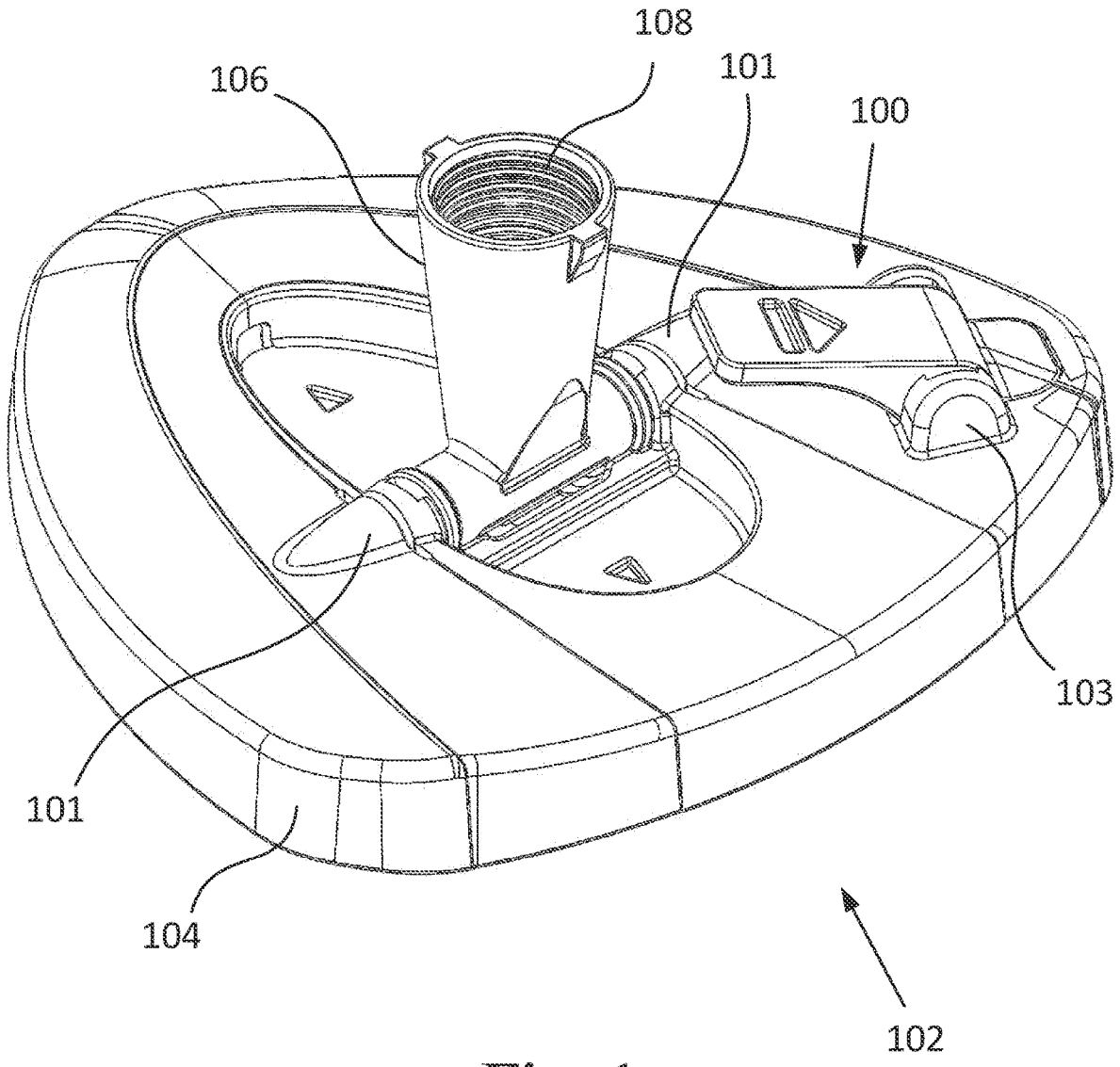
FIG. 1 illustrates a cleaning element receiver with a release mechanism according to an aspect of the disclosure.

FIG. 1 illustrates a release lever 100 integrated in a cleaning element receiver 102. The cleaning element receiver 102 includes a receiver housing 104 and a rod interface 106 for attaching the receiver housing 104 to a rod of a cleaning device. In the embodiment illustrated in FIG. 1, the rod interface 106 includes threads 108 for receiving a threaded rod of a cleaning device. It will be readily understood that other interfacing methods may be used to attach a rod of a cleaning device to a rod interface 106. In the illustrated embodiment, the cleaning element receiver 102 includes first hinge housings 101 and second hinge housings 103. The first hinge housings 101 are configured to form a hinge together with complementary hinge components in the rod interface 106. For example, the first hinge housings 101 may include slots or openings into which protrusions from the rod interface 106 are configured to extend (or vice versa), thereby forming a hinged connection via which the rod interface 106 may pivot. The rod interface is thus configured to pivot about an axis passing between the first hinge housings 101 of the receiver housing 104. The release lever 100 is arranged between the second hinge housings 103. The second hinge housings 103 may be configured in a similar manner to the first hinge housings 101 in that the second hinge housings 103 form a hinge together with complementary parts of the release lever 100. The release lever 100 is configured to pivot about an axis passing between the second hinge housings 103.

As shown in FIG. 1, the receiver housing 104 may have a generally triangular shape with a recess in which the rod interface 106 is hingedly connected to the first hinge housings 101. The rod interface 106 is thus arranged approximately at or near a centroid of the triangle formed by the receiver housing 104. In the illustrated embodiment, the release lever 100 is arranged between one corner of the triangle formed by the receiver housing 104 and the rod interface 106. This positioning of the release lever 100 ensures sufficient space for the release lever 100 is provided, as the release lever must be of a sufficient length and width to be easily handled by a user. Furthermore, the positioning of the release lever 100 at a corner of the triangle formed by the receiver housing 104 ensures sufficient structural rigidity of the receiver housing 104 can be maintained to avoid forces applied via the release lever 100 to the second hinge housings 103 from causing damage to the receiver housing 104. In some embodiments, the receiver housing may have a different shape, such as a circular, square, rectangular, oval, or other polygonal shape. The particular shape of the receiver housing may be based on the particular intended cleaning purpose of a cleaning device. For example, for smaller household applications, a smaller receiver housing may be used. For larger cleaning applications with larger cleaning elements, a larger rectangular receiver housing may be used to apply pressure through the cleaning device to the cleaning elements and a dirty surface more evenly over a larger area. In some embodiments, the release lever may not be arranged in a corner of a polygonal receiver housing. However, it is advantageous for the release lever to be positioned near a periphery of the receiver housing so that leverage applied by the release lever to a cleaning element frame within the receiver housing can be concentrated efficiently and the cleaning element frame can be ejected from the receiver housing more easily. In some embodiments, more than one release lever may be included in a receiver housing where the size of a cleaning element is not conducive to being ejected from a receiver housing based only on a single point of leverage.

Figure 2A:
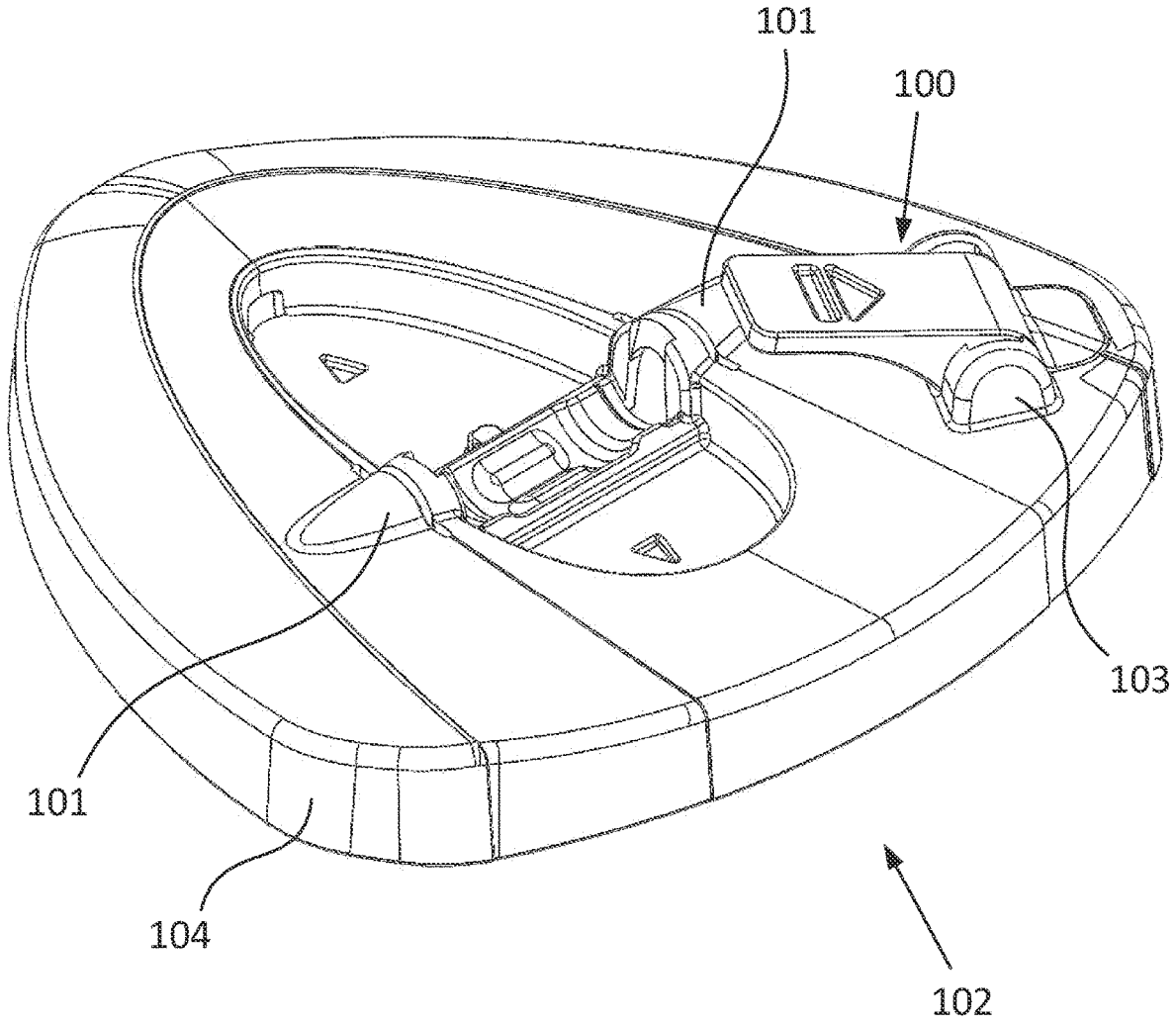
FIGS. 2A and 2B illustrate a cleaning element receiver with a release mechanism at a first position and a second position, respectively.
Figure 2B:
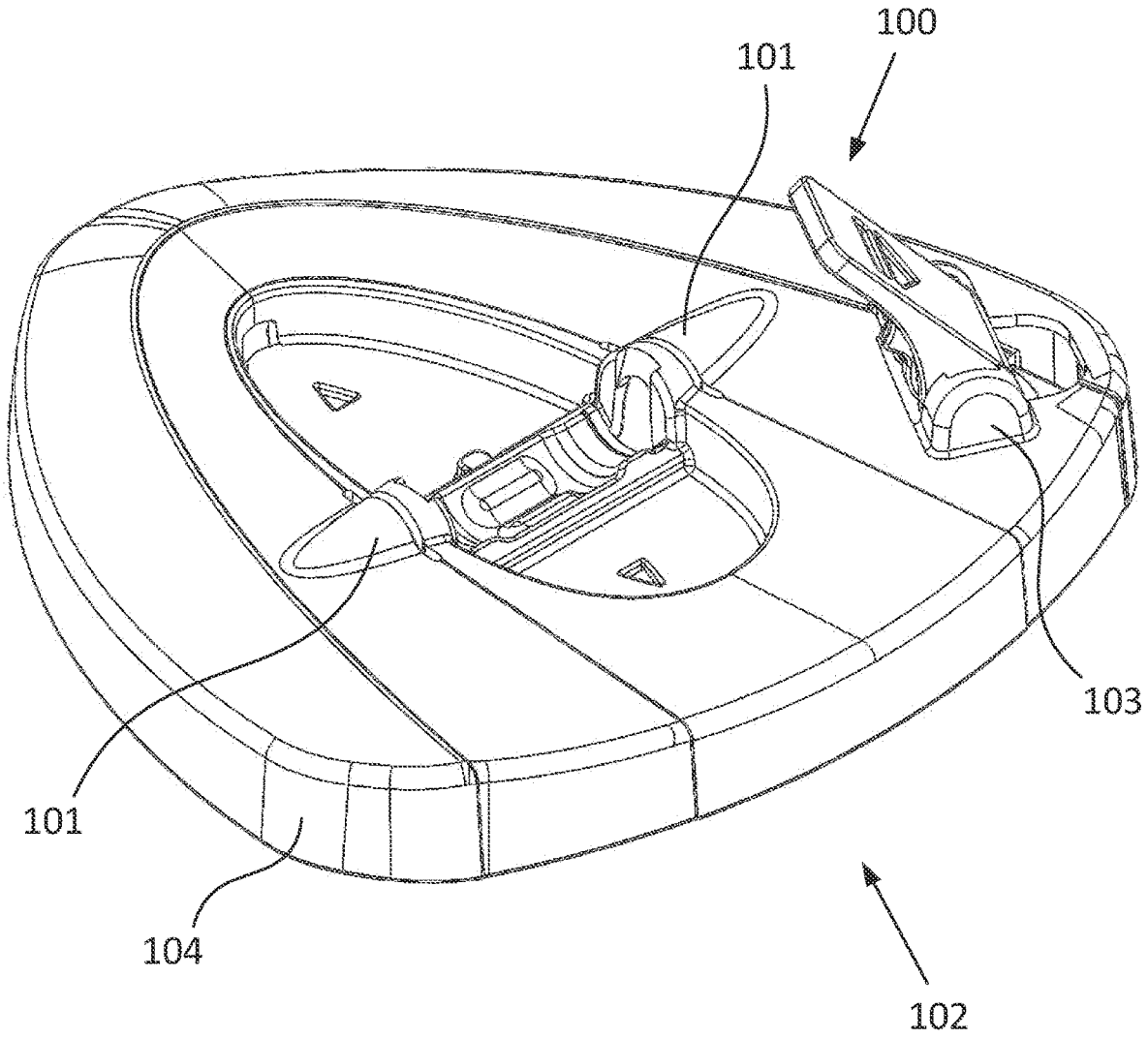

FIGS. 2A and 2B illustrate a cleaning element receiver 102 with a release lever 100 at a first position and a second position, respectively. As illustrated in FIG. 2A, a first position of the release lever 100 corresponds to a position in which the lever is rotated toward the receiver housing 104. The first position corresponds to a neutral position in which the release lever 100 is not "activated" or "engaged" to release a cleaning element form the cleaning element receiver 102. In other words, in the first position, a cleaning element remains secured within the cleaning element receiver 102 and the cleaning element may be used for cleaning a surface. FIG. 2B illustrates release lever 100 in the second position. The second position corresponds to a position in which a cleaning element has been at least partially ejected from the cleaning element receiver 102 due to rotation of portions of the release lever 100. A user may those rotate the release lever 100 from the first position shown in FIG. 2A to the second position shown in FIG. 2B to facilitate release of a cleaning element from the cleaning element receiver 102.

Figure 3A:
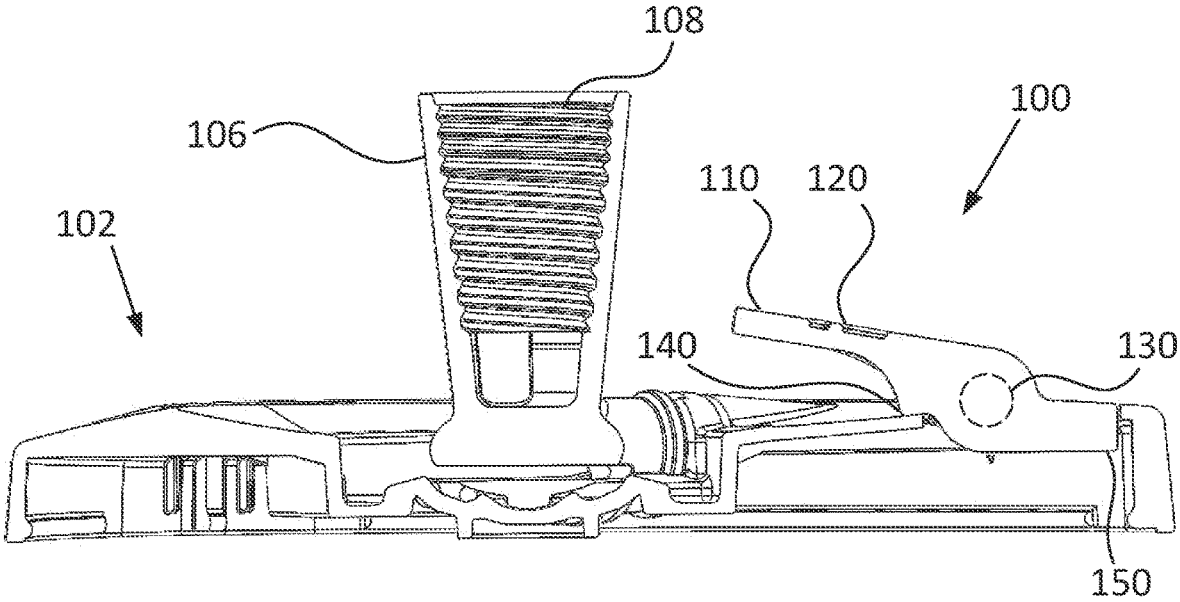
FIGS. 3A and 3B illustrate cross-sectional views of a cleaning element receiver with a release mechanism according to an aspect of the disclosure.
Figure 3B:
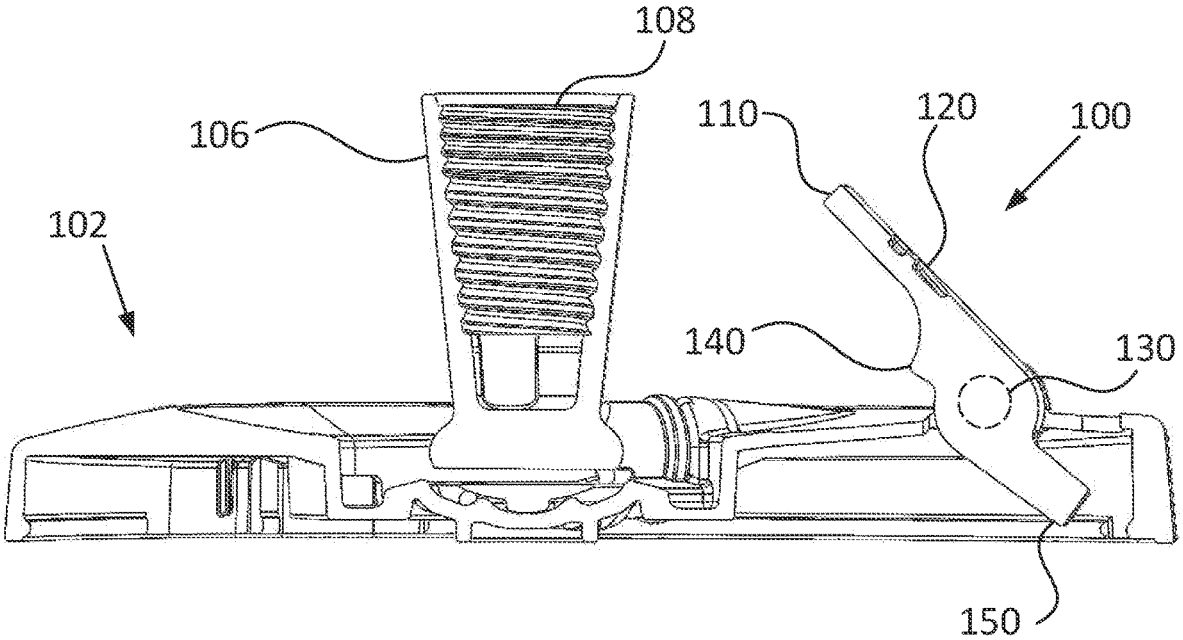

FIGS. 3A and 3B illustrate cross-sectional views of a cleaning element receiver with a release mechanism at the first position and the second position, respectively. As illustrated in both FIGS. 3A and 3B, the release lever 100 includes a handle 110, visual aids 120, a stopper 140, a hinge 130, and an ejector 150. The handle 110 of the release lever 100 is configured for interaction with a user, allowing the user to manually rotate the release lever 100 by applying a force to the handle 110. The force applied to the handle 110 causes the release lever 100 to rotate. If rotation of the release lever 100 is inhibited by a cleaning element, the force is transmitted from the release lever 100 to the cleaning element, as will be described hereafter in greater detail with reference to FIG. 4.

The visual aids 120 of the release lever are configured to convey information to a user. For example, the visual aids 120 may include an arrow indicating a direction of rotation of the release lever, text providing instructions to a user, and/or a symbol indicating the function of the release lever 100. In the illustrated embodiments (and as also shown in FIGS. 1-2B), the visual aids 120 include a universal "eject" symbol, thereby indicating to a user that use of the release lever 100 will result in ejection of a cleaning element held within the cleaning element receiver 102. In the illustrated embodiments, the visual aids 120 comprise indentations within the release lever 100, which may be formed by removal of material from the release lever 100 or by manufacturing the release lever 100 with a mold such that the release lever 100 includes visual aids 120 in its original form. It will be readily understood that visual aids 120 may likewise be formed via added materials or protrusions rather than indentations. In either case, the indentation or protrusion of the visual aids 120 from a surface of the release lever 100 allow the visual aids to be both visual and tactile aids, as a user may feel the indentations and/or protrusions and thereby recognize the component they are feeling, obtain a better grip on the release lever 100, and/or recognize the symbol or instructions of visual aid 120 by feel. In some embodiments, the visual aids 120 may also be added via printing, stamping, or painting, thereby reducing the cost of a mold for producing a more simple and smooth-faced release lever while still conveying necessary information to a user.

The release lever 100 also includes a hinge 130 about which the release lever 100 rotates. As described above, the release lever may include circular protrusions that extend into second hinge housings 103 of the cleaning element receiver 102. In some embodiments, the release lever includes slots or indentations that instead are configured to receive protrusions from the second hinge housings. Irrespective of the particular form of the hinge 130, the release lever 100 is configured to rotate about an axis of the hinge 130. Rotation of the release lever 100 is prevented in a first rotation direction leading to the first position (e.g. FIGS. 2A and 3A) by the stopper 140. The stopper 140 may include a protrusion or a corner configured to interface with an external surface of the receiver housing 102. As shown in FIG. 3A, which illustrates the first position of the release mechanism 100, the stopper 140 abuts an external surface of the receiver housing 102. This interaction acts as a first rotational limit of the release lever 100. Furthermore, when a cleaning element is secured within the cleaning element receiver 102, rotation of the release mechanism 100 is prevented in both rotational directions, as rotation in one direction is prevented by the stopper 140 abutting the external surface of the cleaning element receiver 102 and rotation in the opposite direction is inhibited by a cleaning element abutting the ejector 150 of the release lever 100. As a result, rattling of the release lever 100 within the cleaning element receiver is prevented or avoided altogether during ordinary use of the cleaning device. In the first position, the ejector 150 may abut a portion of a cleaning element secured within the cleaning element receiver 102. Without application of an external force to the release lever 100, the ejector 150 is configured to not exert a substantial force against a cleaning element secured in the cleaning element receiver 102.

As shown in FIG. 3B, which illustrates the second position of the release lever 100, rotation of the handle 110 by a user causes a corresponding rotation of the ejector 150 relative to the hinge 130. This rotation causes the ejector 150 to rotate into an internal cavity of the cleaning element receiver 102, the internal cavity being configured to receive and hold within it the cleaning element. Thus, if a cleaning element is secured within the internal cavity of the cleaning element receiver 102, the ejector 150 applies a force to the cleaning element to dislodge it from within the receiver housing 104 and thereby from the cleaning element receiver 102.

In some embodiments, the handle 110 and the ejector 150 are arranged at opposing ends of the release lever 100 and/or are arranged at opposing portions of the release lever 100 relative to hinge 130. The opposing arrangement of the handle 110 and the ejector 150 enables formation of a lever. Intended input forces corresponding to forces applied by a user and output forces corresponding to forces applied by the release lever 100 to a cleaning element may be adjusted based on the length of the release lever 100 or based on the position of the handle 110 and ejector 150 relative to the hinge 130. For example, if the force that must be applied by ejector 150 to a cleaning element to eject the cleaning element from within the cleaning element receiver 102 is high, the release lever 100 may be configured with a handle that is longer and positioned farther from hinge 130. This reduces the amount of input force required to apply the leverage necessary to eject the cleaning element. On the other hand, if output forces required to eject a cleaning element are low, the handle 110 can be shorter and positioned closer to the hinge 130, thereby facilitating a more compact design.

In the first position, the handle 110 of the release lever 100 is angled with respect to an external surface of the cleaning element receiver 102 so that a user may insert one or more fingers or objects between the handle 110 and the external surface of the cleaning element receiver 102. In some embodiments, the end of the release lever opposite the handle 110 relative to the hinge 130 (e.g. the end of the release mechanism with ejector 150) is parallel with and/or flush with a surface of the cleaning element receiver 102 when in the first position. This way, the release lever 100 can maintain a more aesthetically pleasing appearance while in the first position, and unnecessary protrusion of the release lever 100 from the cleaning element receiver 102 can be avoided to prevent unwanted catching on objects during cleaning.

In some embodiments, the ejector 150 is configured to not protrude from outer boundaries delimited by the cleaning element receiver 102 when in a first position. In some embodiments, the ejector 150 is configured to not protrude from within an internal cavity defined by the cleaning element receiver 102 when in the second position. Unwanted protrusion of the ejector from the cleaning element receiver 102 can thereby be avoided, decreasing the likelihood of a textile of the cleaning element, or other external objects, from catching on the ejector 150.

Figure 4:
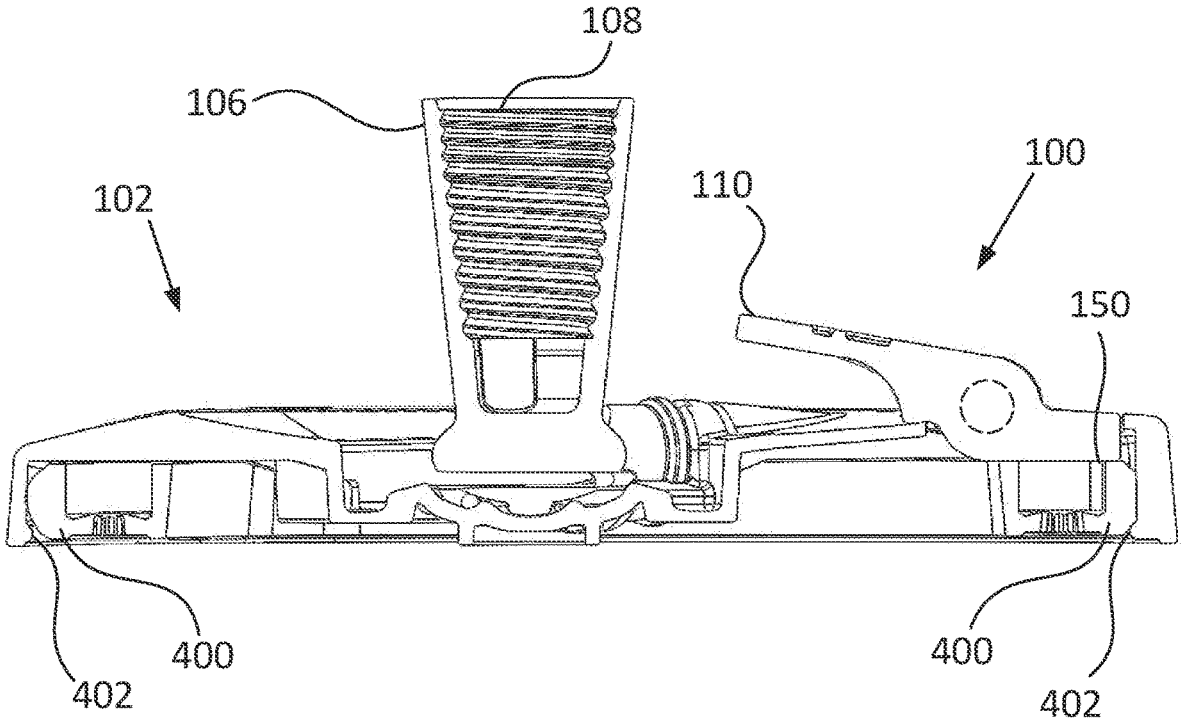
FIG. 4 illustrates a cross-sectional view of a cleaning element receiver with a release mechanism and a cleaning element frame according to an aspect of the disclosure.

FIG. 4 illustrates a cross-sectional view of a cleaning element receiver 102 with a release lever 100 and a cleaning element frame 400. The cleaning element frame 400 is configured to fit at least partially within an internal cavity defined by the cleaning element receiver 102. In the illustrated example, the cleaning element receiver 102 includes retaining protrusions 402 configured to abut the cleaning element frame 400 about at least portions of the perimeter of the receiver housing 104. The retaining protrusions 402 secure the cleaning element frame 400 to the receiver housing 104, and are configured to maintain secure attachment of the cleaning element frame 400 until a certain force, referred to herein as an ejecting force, is applied to the cleaning element. Thus, while the retaining protrusions 402 are configured to prevent ejection of a cleaning element from the cleaning element receiver 102, the retaining protrusions 402 are likewise configured to allow ejection of the cleaning element once an ejecting force is applied by the ejector 150 of the release lever 100 to the cleaning element frame 400. The cleaning element frame 400 is configured to fit in a form-fitting manner within the receiver housing 104. Specifically, the receiver housing 104 includes an internal cavity configured to fit the cleaning element frame 400.

Figure 5:
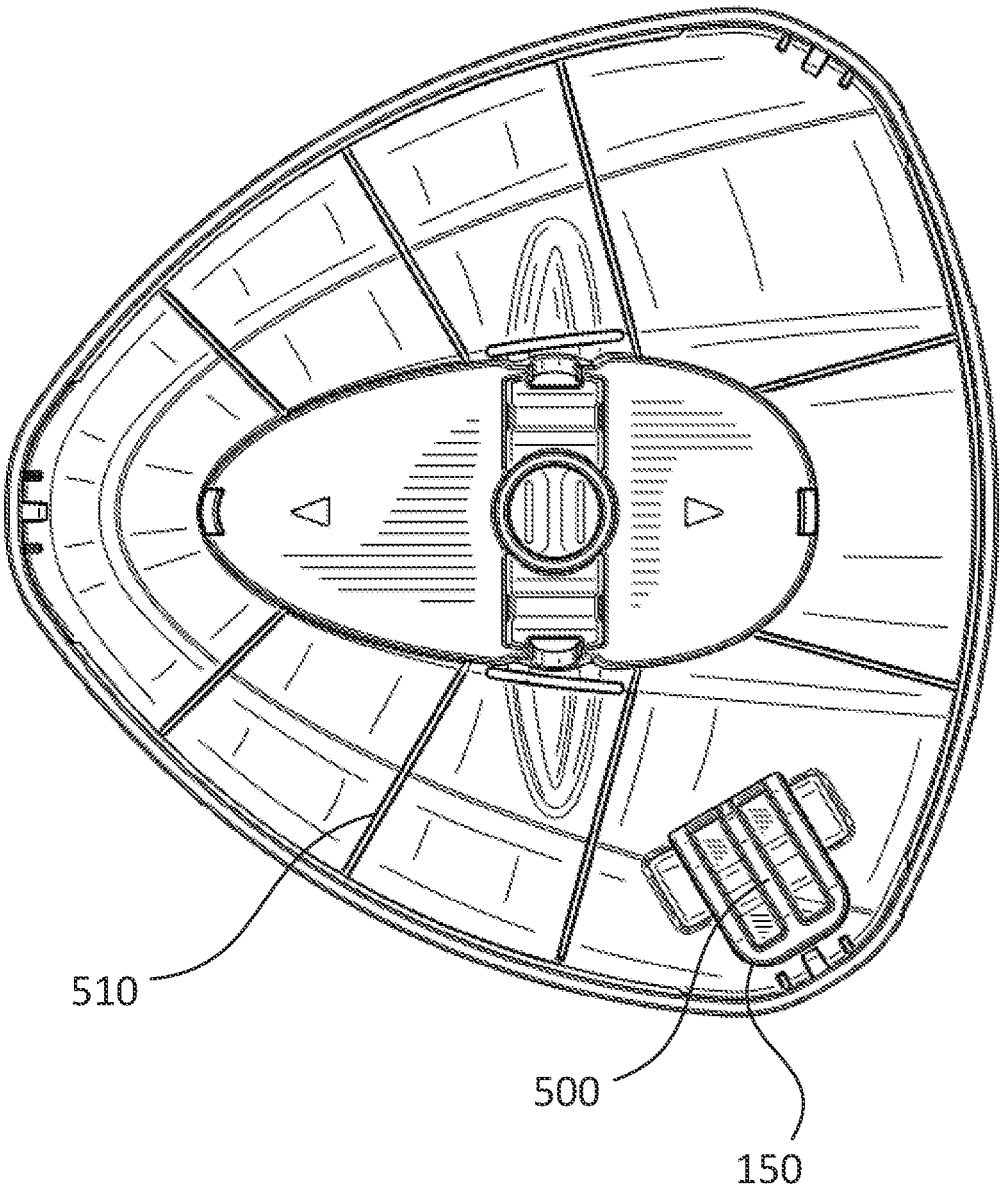
FIG. 5 illustrates a bottom view of a cleaning element receiver with a release mechanism according to an aspect of the disclosure.

FIG. 5 illustrates a bottom view of a cleaning element receiver with a release mechanism according to an aspect of the disclosure. More specifically, FIG. 5 illustrates a bottom view of the ejector 150 of a release lever. In some embodiments, such as the embodiment illustrated in FIG. 5, the ejector 150 includes ribs 500 arranged in parallel and converging and/or merging at at least one end of the ribs 500 to provide sufficient structural rigidity while reducing the amount of material required to form the release lever. In some embodiments, the ribs are not included and the lower surface of the ejector 150 instead includes a single planar surface, thereby increasing the strength of the lever and increasing its durability. As also illustrated in FIG. 5, the cleaning element receiver 102 may include ribs 510 to provide structural rigidity.

It will be readily appreciated that the present disclosure also discloses a method of operating a cleaning device corresponding to disclosed structures. In an embodiment, for example, a method of operating a cleaning device includes replacing a cleaning element by using a release lever. Specifically, after a first cleaning element becomes soiled or otherwise requires replacement, a user may user the release lever to eject the first cleaning element via its frame. A second cleaning element attached to a different frame can then be reinserted in the cleaning element receiver to replace the first cleaning element. Advantageously, a user may carry out this process without having to touch a soiled cleaning element that needs to be replaced, making replacement of a cleaning element and cleaning operations overall a more convenient process for a user. It will also be readily appreciated that various steps of the method for replacing an interchangeable cleaning element may also be carried out depending on specific structural features of the foregoing disclosure. For example, in embodiments of a release lever including a stopper configured to abut an external surface of the cleaning element receiver, part of the method for interchanging a cleaning element may include inserting a new or replacement cleaning element frame into the cleaning element receiver until the release lever is rotated to a position such that the stopper is caused to abut the external surface of the cleaning element receiver.

While subject matter of the present disclosure has been illustrated and described in detail in the drawings and foregoing description, such illustration and description are to be considered illustrative or exemplary and not restrictive. Any statement made herein characterizing the invention is also to be considered illustrative or exemplary and not restrictive as the invention is defined by the claims. It will be understood that changes and modifications may be made, by those of ordinary skill in the art, within the scope of the following claims, which may include any combination of features from different embodiments described above.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A cleaning device, comprising:

a cleaning head receiver having a triangular shape;

a cleaning head frame;

a cleaning material attached to the cleaning head frame;

a rod fitting, the rod fitting being arranged at a centroid of the triangular cleaning head receiver; and a release lever having a handle at a first end and an ejecting surface at a second end, the release lever being arranged within the cleaning head receiver, wherein the release lever is configured to rotate and thereby apply an ejecting force against the cleaning head frame via the ejecting surface, and wherein the release lever is arranged between the rod fitting and a corner of the triangular cleaning head receiver.

2. The cleaning device of claim 1, wherein the release lever comprises a hinge with an axis of rotation that passes through the cleaning head receiver, and wherein the first end is opposite the second end relative to the hinge.

3. The cleaning device of claim 1, wherein the release lever is configured to receive a force applied by a user to the handle and transmit a proportional force as the ejecting force against the cleaning head frame.

4. The cleaning device of claim 1, wherein the cleaning head receiver includes parallel ribs joined at an end to form the ejecting surface.

5. The cleaning device of claim 1, wherein the cleaning head receiver comprises a receiving cavity configured to receive the cleaning head frame, the receiving cavity being shaped to conform in a form-fitting manner to a shape of the cleaning head frame.

6. The cleaning device of claim 5, wherein the cleaning head receiver comprises one or more protrusions configured to retain the cleaning head frame within the receiving cavity and resist expulsion of the cleaning head frame from the receiving cavity up to a threshold force.

7. The cleaning device of claim 6, wherein the cleaning head frame is configured to be ejected from the cleaning head receiver upon the ejecting force being applied by the ejecting surface to the cleaning head frame exceeding the threshold force.

8. The cleaning device of claim 5, wherein the ejecting surface is configured to be parallel to and/or coincident with an internal surface of the cleaning head receiver that delimits part of the receiving cavity.

9. The cleaning device of claim 5, wherein the ejecting surface is configured to abut the cleaning head frame while the cleaning head frame is fully retained in the cleaning head receiver.

10. The cleaning device of claim 2, wherein the release lever includes a stopper portion configured to abut an external surface of the cleaning head receiver, the stopper portion being configured to thereby prevent rotation of the release lever in a first rotational direction about the axis of rotation.

11. The cleaning device of claim 10, wherein the ejecting force is applied by the ejecting surface of the release lever in a second rotational direction about the axis of rotation that is opposite the first rotational direction.

12. The cleaning device of claim 11, wherein the stopper portion is shaped as a corner protruding away from the axis of rotation, the stopper portion being arranged on a side of the release lever together with the handle and on an opposite side of the release lever from the ejecting surface relative to the hinge.

13. The cleaning device of claim 1, wherein the cleaning material includes one or more surface cleaning materials configured to absorb liquid and collect debris on a cleaning surface.

* * * * *